US005856267A

United States Patent [19]

Sherman et al.

[11] Patent Number: 5,856,267

[45] Date of Patent: Jan. 5, 1999

[54] TRANSFER PRINTING METAL SUBSTRATES

[75] Inventors: Louis R. Sherman, Botkins; Phillip G. Elmore, Sydney, both of Ohio

[73] Assignee: American Trim, LLC, Lima, Ohio

[21] Appl. No.: 925,107

[22] Filed: Sep. 8, 1997

Related U.S. Application Data

[63] Continuation of Ser. No. 698,266, Aug. 14, 1996, abandoned, which is a continuation of Ser. No. 476,523, Jun. 7, 1995, abandoned.

[51] Int. Cl.[6] ..... B41M 5/035; B41M 5/38

[52] U.S. Cl. ..... 503/227; 428/195; 428/209; 428/421; 428/422

[58] Field of Search ..... 8/471; 428/195, 428/209, 211, 421, 422, 913, 914

[56] References Cited

U.S. PATENT DOCUMENTS

| | | | |
|---|---|---|---|
| 4,587,155 | 5/1986 | Durand | 428/195 |
| 4,668,239 | 5/1987 | Durand | 8/471 |
| 4,670,084 | 6/1987 | Durand | 156/540 |
| 5,290,424 | 3/1994 | Mozelewski et al. | 205/160 |
| 5,318,942 | 6/1994 | Laudy et al. | 503/227 |

FOREIGN PATENT DOCUMENTS

| | | | |
|---|---|---|---|
| 1108929 | 9/1981 | Canada | 428/209 |
| 9221514 | 12/1992 | WIPO | 503/227 |

OTHER PUBLICATIONS

Stahls' 1993–94 Buyer's Guide, "Personalization Pays!", pp. 1–3, 38 and back cover.

Neuman Robert B "Sublimation Printing on Unsealed Aluminum Metal." *Light Metal Finishing Session K* pp. 1–6.

Unsealed Paper Sublimation System Inc (Ciera 1979).

*Primary Examiner*—Bruce H. Hess

*Attorney, Agent, or Firm*—Rankin, Hill, Porter & Clark LLP

[57] ABSTRACT

A process for transfer printing sheet metal which is especially suited for manufacture into three-dimensional articles such as appliance panels and one-piece pictures and frames. A decorative image is transfer printed in a clear top coat on the sheet metal by pressing transfer paper against the clear coat using a printing press which includes an upper heated platen having a polished undersurface with a polymer facing sheet covering the polished undersurface. The transfer paper has an adhesive on its surface facing the polymer sheet on the platen so the transfer paper will temporarily adhere to the platen when the printing press is opened for removal of the decorated sheet metal.

27 Claims, 1 Drawing Sheet

TRANSFER PRINTING METAL SUBSTRATES

RELATED APPLICATION

This application is a continuation of application Ser. No. 698,266 filed on Aug. 14, 1996, now abandoned which is a continuation of application Ser. No. 08/476,523 filed Jun. 7, 1995 and entitled the same, now abandoned.

BACKGROUND OF THE INVENTION

This invention relates to transfer printing of sheet metal and in particular to a method and apparatus for transfer printing an image on the coated sheet metal. Transfer printing such as sublimation printing transfers dyes or inks into the clear coating on the metal by pressing transfer paper against the clear coated surface under heat and pressure.

Transfer printing of inks or dyes into a variety of articles such as shirts, mugs, plastic articles and plastic coated substrates is well-known in the art. Dispersible dye crystals or inks are printed in reverse images in transfer paper which is to be used to transfer print the article to be decorated. The article to be decorated is usually made of plastic or has a plastic or polymer coating on it into which the dyes are transferred.

Most transfer printing is referred to as sublimation printing in which the dyes are said to sublimate under heat and pressure to be driven into any receptive substrate that is put in contact with the transfer paper. Such sublimation printing was developed circa 1969 and has been used extensively to print many articles including plastic coated metal substrates.

Transfer printing also includes a melt printing process which is as described in several patents and patent applications including U.S. Pat. Nos. 4,587,155; 4,670,084; 4,668,239 and Published Application WO 92/21514. According to U.S. Pat. No. 4,587,155, the desired dye image is transferred from the paper to the substrate by heating the dye to a temperature above its melting point but below its vaporization temperature so the dye will diffuse into the softened plastic substrate. Published Application WO 92/21 514 describes melt printing of planar metal base members such as aluminum, steel or the like which have been coated on at least one planar surface with a melt printable layer of softenable, dye-permeable, thermoplastic or thermoset material such as polyethylene terephthalate, polybutylene terephthalate or other thermoplastic polyesters, polycarbonates, nylons and the like. Application WO 92/21514 further describes bilayer coatings of thermoplastic or thermoset materials including a base coat optimally provided with a pigment and a second layer that can comprise a clear resin.

Canadian Patent 1,108,929 describes a process for applying designs to unsealed, anodized aluminum which is continuously heated to a temperature at which colored components of ink will sublime. The heated strip is ted into contact with an ink carrying web so the ink is heated and transferred into the anodized aluminum surface. The decorated aluminum strip is then cooled with water and passed through a sealing bath filled with a sealing solution such as buffered aqueous nickel.

A variety of machines are commercially available for transfer printing textiles, mouse pads and the like. For example, the George Knight Company sells a transfer printing machine that has upper and lower platens for pressing transfer paper against textiles under heat and pressure to cause dyes from the paper to be transferred into the textile material.

An improved system is needed for transfer printing metal substrates to produce decorated sheets having consistent bright coloring with little or no texturing of the surface of the sheet. The process should produce decorated sheet metal to be formed into shaped articles such as appliance panels or three-dimensional pictures and signs without cracking or crazing of the coatings on the sheet metal. Transfer printing of metal substrates has heretofore frequently resulted in inconsistent and uneven transfer (mottling and/or ghosting) of the transferred images. Solid color areas have been difficult to produce in acceptable quality due to mottling. Ghosting is a faint offset second image which makes the product unacceptable. A process is needed for producing a sharp and consistent image in a variety of mass-produced products such as appliance panels, one-piece three-dimensional pictures and frames.

SUMMARY OF THE INVENTION

This invention provides a system for transfer printing decorative or informative images onto metal substrates. In accordance with this method, coated strip metal or metal sheets are transfer printed as by sublimation printing or alternatively by melt printing. A preferred system includes a press having upper and lower platens which heal the transfer paper and press it against a metal substrate. The platen which contacts the transfer paper has a Teflon® sheet on its face adjacent the paper to protect the finish on the platen and distribute the pressure evenly against the paper and the underlying metal substrate. A diluted adhesive such as glue is applied to the surface of the transfer paper which faces the Teflon® sheet so the paper will temporarily adhere to the Teflon® sheet when the press is opened following completion of transfer printing.

Accordingly, an object of this invention is to provide an improved process for transfer printing sheet metal.

Another object is to provide transfer printed metal sheets having improved clarity and uniformity of print quality.

The above and other objects and advantages of this invention will be more fully understood and appreciated with reference to the following description and the claims appended hereto.

DESCRIPTION OF PREFERRED EMBODIMENTS

Figure 1:
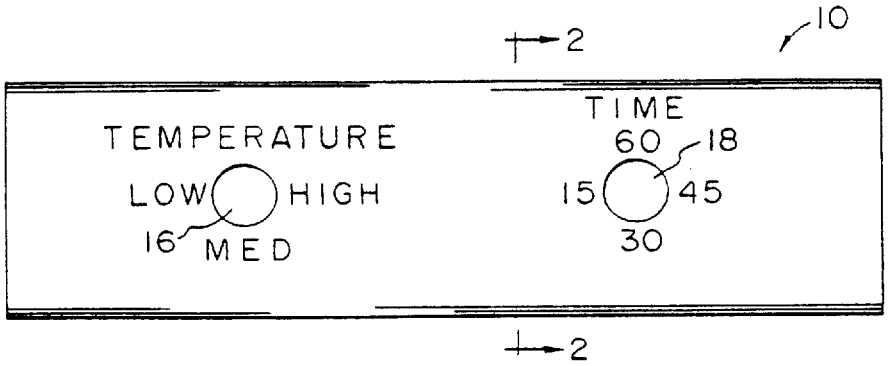
FIG. 1 is a plan view of an appliance panel which has been produced in accordance with this invention.
Figure 2:
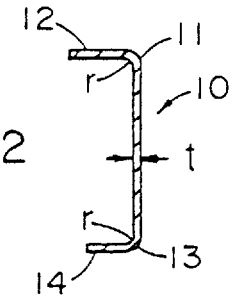
FIG. 2 is a cross-sectional view through the panel of FIG. 1 taken along line 2—2 in FIG. 1.

Referring to the drawings, FIGS. 1 and 2 show an appliance panel 10 which is suitable to be printed in accordance with this invention. The panel is made from sheet metal and preferably sheet aluminum which is about 0.010 to 0.040 inch thick and preferably about 0.019 inch thick. In a preferred embodiment, the aluminum can be a 3000 or 5000 series alloy such as 3004 or 5052, as designated by the Aluminum Association, in an intermediate to hard temper. As best seen in FIG. 2, the panel 10 has been formed to provide flanges on it for attachment to an appliance such as a washing machine or clothes dryer. Holes 16, 18 have also been punched or cut in the panel 10 for receiving pins, not shown, for dials or knobs to be attached for operating machine controls. The panel has also been coated and printed with instructions and settings for operation of the appliance.

Figure 3:
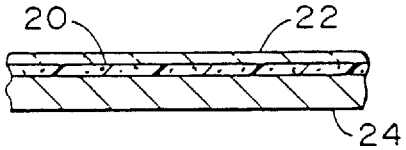
FIG. 3 is an enlarged fragmentary cross-sectional view of the panel of FIG. 1.

FIG. 3 is an enlarged cross section through the panel 10 of FIGS. 1 and 2 showing a base coat 20 and a top coat 22 on the metal substrate 24. The metal substrate is in strip form and has preferably been cleaned as for example with a Betz MetChem solution such as Betz® 1010 to remove oils, grease or other contaminants from at least one surface of the strip. The base coat 20 may be a variety of thermosetting polymers such as polyesters, epoxies or the like, and has a pigment such as titanium oxide in it to provide a solid color background for printing. In a preferred embodiment, the base coat 20 is a thermosetting polyester enamel such as white appliance enamel sold by Lilly Industries, Inc. of Indianapolis, Indiana under Code 95101-7299.

The top coat 22 may also be a variety of thermosetting polymers such as polyesters and epoxies. A preferred top coat 22 is a thermosetting polyester sold by Lilly Industries, Inc. under Code 95110-7300. The top coat must be substantially clear so it will not screen or interfere with visibility of the transfer inks or dyes which are diffused into the coating.

The base coat and top coat are preferably roll coated on the metal substrate. The base coat is cured after it is applied, followed by roll coating and curing of the top coat. The coatings are preferably cured at about 350°–450° F., and more preferably about 410° F. for about 20–40 seconds, and more preferably about 30 seconds.

Figure 4:
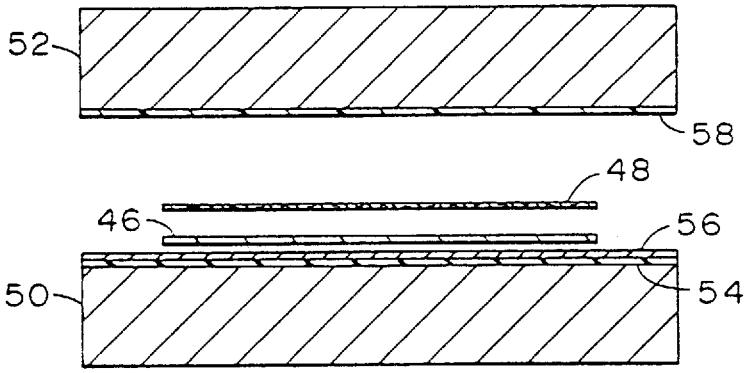
FIG. 4 is a cross-section through apparatus for sublimation printing metal substrate in accordance with this invention.

FIG. 4 shows printing press apparatus for sublimation printing of a sheet 46 of coated substrate in accordance with this invention. The apparatus includes a base or bottom platen 50 on which a coated metal sheet 46 and a sheet of transfer paper 48 are positioned and a top platen 52 for pressing the sheet of transfer paper 48 against the metal sheet to transfer dyes from the paper into the top coat on the metal sheet. The bottom platen preferably has a layer of rubber such as silicone 54 and a felt mat 56 on it for distributing the pressing force against the metal sheet. The rubber layer 54 may be about ½ inch thick and the felt layer may be about ¼–½ inch thick, and may comprise one, two or more layers of felt.

It is important to this invention that the top platen 52 have a layer or sheet 58 of plastic or polymer such as Teflon® polymer on its bottom surface to protect the surface of the platen and provide a slightly resilient surface to apply pressure uniformly against the paper 48 and the metal sheet 46 as supported by the bottom platen 50. Teflon° is a registered trademark of E.I. du Pont de Nemours and Company, Inc for fluorocarbon polymers. The bottom surface of platen 52 must be flat and polished in order to avoid or minimize possible imprinting of imperfections from such surface into the coatings on the metal substrate 46. The polymer sheet 58 protects the polished surface of the platen 52 and evenly distributes the transfer pressure without interfering with heat transfer. The polymer sheet 58 is preferably relatively thin, with a thickness of about 0.020 to 0.030 inch.

The top platen 52 preferably has heating means such as electrical heating rods or coils, not shown, for heating the transfer paper 48 and metal sheet 46. Alternatively, the bottom platen 50 or both the bottom and top platens can have heating coils in them for heating the metal sheet and transfer paper. In a preferred embodiment, the bottom platen 50 is moved vertically, as for example with an air bag or bags, not shown, to press the paper 48 and metal sheet 46 tightly together to heat them and cause sublimation transfer of the dye or dyes into the top coat on the metal sheet. As used herein, "dye" means either dye or ink which may be used to create an image and/or color in a substrate. In one preferred embodiment, the top platen 52, paper 48 and metal sheet 46 are heated to about 375°–450° F. and pressed together under a pressure of approximately 50–80 psi. The peak metal temperature in sheet 46 is preferably about 350°–370° F. The heat and pressure is held for a cycle time in a range of about 10–60 seconds depending on a variety of factors such as the dye colors, kinds and quantity of dyes to be transferred, coating composition, and pressures employed. The transfer press is then opened by lowering the bottom platen 50, and the decorated sheet 46 and expended paper 48 are removed from the press.

In a preferred embodiment of this invention the metal sheet 46 and transfer paper 48 both have at least two small matching holes in them for receiving pins, not shown, on the bottom platen 50 for registering the paper and the image on the paper with respect to the metal sheet. One of the pins on the platen 50 is preferably movable perpendicular to its vertical axis to accommodate expansion of the metal sheet 46 when the sheet is heated during transfer printing. The holes in the metal sheet 46 are in portions of the sheet, such as marginal edges, which will not be seen or which are trimmed off the metal sheet in the finished product.

A transfer printing press for practice of this invention preferably has platens large enough to print a plurality of metal sheets in each press cycle. For example, a press supplied by the George Knight Company has platens large enough to print four coated metal substrates which are 11½ inches by 28 inches. Four metal substrates 46 are positioned side by side on pins on the lower platen, and four sheets of transfer paper 48 are positioned in overlying relationship with the substrates.

It is also important to this invention that the transfer paper 48 be separated from the metal substrate 46 as the press is opened to minimize possible "ghosting" of the image on the substrate. In a preferred mode of operation the transfer paper has spots of adhesive applied to its top surface so the paper will at least temporarily stick to the top platen 52 when the press is opened after completion of printing. The adhesive may, for example, be diluted Elmers® (a trademark of Borden, inc.) glue. The glue may be diluted with approximately an equal amount of water. With such adhesive, the paper 48 is temporarily adhered to the top platen 52 when the press is opened. However, the adhesive will promptly release and the expended paper will fall from the platen within a few seconds after opening of the press so the paper can be easily removed and discarded. Meanwhile, the decorated metal sheet 48 is removed from the press so the sheet will not be degraded by the expended transfer paper 46.

The process of this invention is especially well adapted for producing decorated sheet metal that can be formed into three-dimensional articles such a appliance panels and one-piece pictures and frames which are durable and attractive. The coatings on the metal substrate employed with this invention are thin, uniform in thickness durable and especially well suited for transfer printing of clear well defined images. The coated and decorated substrates can be formed with small radii of curvature without cracking or crazing of the coatings. This invention produces clear images in the clear coating on the substrate with a minimum of ghosting or mottling of the images or colors in the images.

Having provided a detailed description of preferred embodiments for practicing the invention, it will be apparent to those skilled in the art that numerous modifications can be made in such embodiments without departing from the invention or the scope of the claims appended hereto. For example, the coated metal sheets can be preheated before they are placed in the apparatus of FIG. 4 for sublimation printing. A further alternative for the apparatus of FIG. 4 includes moving the top platen, instead of the bottom platen to open and close the press for transfer printing. Vacuum means can also be used in place of adhesive to temporarily retain the transfer paper on the upper platen when a printing press is opened after completion of the transfer printing. Other alternatives falling within the scope of the invention will be apparent to those skilled in the art.

What is claimed is:

1. A process for transfer printing sheet metal comprising:

providing sheet metal having at least one surface coated with a thermoset polymer base coat containing a pigment and a clear thermoset top coat over the base coat;

providing transfer paper having a reverse printed dye image in the paper;

pressing said transfer paper against said clear top coat with a first metal platen having a polished finish with a fluoro carbon polymer layer thereover facing said transfer paper; and heating said paper to transfer said image into said clear coat.

2. A process as set forth in claim 1 in which said sheet metal is supported on a second metal platen and at least one of said first and second platens is moved vertically to press said transfer paper and said sheet metal against each other.

3. A process as set forth in claim 2 in which said second platen is moved vertically.

4. A process as set forth in claim 2 in which said transfer paper has an adhesive on its surface for disposition against said polymer layer to temporarily adhere said paper to said layer when at least one of said platens is moved following completion of said transfer of the image into said clear coat.

5. A process as set forth in claim 2 in which at least one of said platens is moved vertically by at least one inflatable air bag.

6. A process as set forth in claim 2 in which said second platen has a rubber layer on its upper surface.

7. A process as set forth in claim 6 which includes a felt mat on top of said rubber layer.

8. A process as set forth in claim 6 in which said rubber layer comprises silicone.

9. A process as set forth in claim 1 in which said sheet metal comprises an aluminum alloy.

10. A process as set forth in claim 1 in which said sheet metal has a thickness in a range of about 0.010 to 0.040 inches.

11. A process as set forth in claim 1 in which said paper and said sheet metal is heated to one or more temperatures between about 350°–450° F.

12. A process for transfer printing sheet metal comprising:

providing sheet metal having at least its top surface coated with a thermoset polymer base coat containing a pigment and a clear thermoset top coat over the base coat;

placing said sheet metal in a transfer printing press having an upper platen and a lower platen, at least one of which platens includes heating means and said upper platen has a polished finish on its undersurface with a fluorocarbon polymer layer covering said polished finish;

providing transfer paper having a reverse printed dye image in it, said paper having adhesive on its upper surface;

placing said paper on said sheet metal;

moving at least one of said platens toward the other said platen to heat said transfer paper and press it against said clear top coat for transfer of said image into said clear coat;

moving at least one of said platens away from the other said platen with said transfer paper temporarily adhering to said upper platen; and removing said sheet metal from said transfer printing press.

13. A process as set forth in claim 12 in which said lower platen is moved upward by at least one inflatable air bag.

14. A process as set forth in claim 12 in which said bottom platen has a rubber layer on its upper surface.

15. A process as set forth in claim 14 which includes a felt mat on top of said rubber layer.

16. A process as set forth in claim 14 in which said rubber layer comprises silicone.

17. A process as set forth in claim 12 in which said sheet metal comprises an aluminum alloy.

18. A process as set forth in claim 12 in which said sheet metal has a thickness in a range of about 0.010 to 0.040 inches.

19. A process as set forth in claim 12 in which said transfer paper and said sheet metal is heated to one or more temperatures between about 350° and 450° F.

20. A process as set forth in claim 12 in which said sheet metal and said transfer paper are positioned on pins projecting from said lower platen to locate the image on said paper with respect to said sheet metal.

21. A process as set forth in claim 20 in which said lower platen has two pins on it for registering said sheet metal and said paper and one of said pins is moveable for accommodating expansion of the sheet metal when the sheet metal is heated.

22. A process as set forth in claim 12 in which a plurality of metal sheets are positioned adjacent one another on said lower platen and a sheet of transfer paper is positioned on each of said metal sheets.

23. A process as set forth in claim 22 in which said lower platen has two pins projecting therefrom for locating each of said metal sheets.

24. A process for transfer printing sheet metal comprising:

providing sheet metal having at least one surface coated with a thermoset polymer base coat containing a pigment and a clear thermoset top coat over the base coat;

providing transfer paper having a reverse printed dye image in the paper;

pressing said transfer paper against said clear top coat; and heating said paper to transfer said image into said clear coat.

25. A process as set forth in claim 24 in which said transfer paper and said sheet metal is heated to one or more temperatures between about 350°–450° F.

26. A process as set forth in claim 24 in which said sheet metal comprises an aluminum alloy.

27. A process as set forth in claim 24 in which said sheet metal has a thickness in a range of about 0.010 to 0.040 inches.

* * * * *